US005734355A

United States Patent [19]

Watanabe

[11] Patent Number: 5,734,355

[45] Date of Patent: Mar. 31, 1998

[54] COUPLING DEVICE FOR COAXIAL CABLE AND ANTENNA APPARATUS

[75] Inventor: Hironobu Watanabe, Yono, Japan

[73] Assignee: Daiichi Denpa Kogyo Kabushiki Kaisha, Tokyo-To, Japan

[21] Appl. No.: 420,367

[22] Filed: Apr. 11, 1995

[30] Foreign Application Priority Data

Apr. 12, 1994 [JP] Japan ..... 6-073544

[51] Int. Cl.[6] ..... H01Q 1/32; H01Q 1/50

[52] U.S. Cl. ..... 343/859; 343/715; 343/860; 333/25; 333/33

[58] Field of Search ..... 343/859, 715, 343/850, 860, 713; 333/25, 33; H01Q 1/50

[56] References Cited

U.S. PATENT DOCUMENTS 4,621,243 11/1986 Harada ..... 343/715

4,764,773 8/1988 Larsen et al. ..... 343/715

4,992,800 2/1991 Parfitt ..... 343/715

*Primary Examiner*—Michael C. Wimer

*Attorney, Agent, or Firm*—Fish & Richardson P.C.

[57] ABSTRACT

A coupling device for coaxial cable which can maintain coaxial transmission mode of low loss is provided. In the coaxial cable coupling device of the capacitor coupling type, in the case where center conductor coupling electrodes for connecting between center conductors of the coaxial cables and external conductor coupling electrodes for connecting between external conductors are used, electric length of the external conductor coupling electrode is set to length of substantially one fourth (¼) wavelength, or length of multiple of odd number of substantially one fourth (¼) wavelength of a passing signal. Thus, transmission by the coaxial transmission mode is carried out at an extremely low loss.

8 Claims, 14 Drawing Sheets

COUPLING DEVICE FOR COAXIAL CABLE AND ANTENNA APPARATUS

BACKGROUND OF THE INVENTION

This invention relates to a coupling device for coaxial cable, and more particularly to a coupling device for coaxial cable that can connect between radio (wireless) equipment (devices) installed at the inside and the outside of closed space such as vehicle or interior of a room, etc. by means of coaxial cables without providing penetration hole. In addition, this invention relates to an antenna apparatus using such a coupling device for coaxial cable.

Hitherto, a radio equipment mounted in a vehicle, so called vehicle mount radio equipment comprises a radio equipment body of transceiver (transmitter/receiver) installed within the vehicle, a transmitting/receiving antenna installed outside the vehicle, and a coaxial cable connecting between the radio equipment body and the antenna. The coaxial cable is going out of the interior of compartment which is closed space toward the outside of the vehicle, and is connected to the antenna. For this purpose, there is employed either a method in which a hole through which the coaxial cable is penetrated is opened at the vehicle body, or a method in which a thin coaxial cable is partially used, or the like to pass that coaxial cable through gap (clearance) of the door of the vehicle. Similarly, also in connection between a radio equipment such as television, etc. disposed within a room of residence (house) which is closed space and a receiving antenna disposed outdoor, coaxial cable connecting therebetween is wired passing through a hole opened at a portion of building or a gap of window.

However, opening of hole in order to pass coaxial cable through the vehicle body is troublesome work, and disadvantageously lowers the property value of the vehicle. On the other hand, when the method utilizing gap of door is employed, there is the possibility that the coaxial cable may be broken. In addition, wind cutting sound or leakage of water from hole or gap may also become problem.

Similarly, in building, particularly building of reinforced concrete, etc., it is troublesome to open a hole later. Generally, it is not permitted to open a hole at the wall in apartment-house or leased house, etc.

In view of the above, as a method in which it is not required to open a hole at the vehicle body or the wall surface, a method has been devised in which an antenna is installed on a window glass to deliver a high frequency signal from a coaxial cable inside the window glass through capacitor (capacitively) coupled portion where electrodes are attached (stuck) on both sides of the window glass. FIG. 1A shows an example of an antenna apparatus of KG 144 type by LASEN ELECTRONICS, Inc. USA. In this antenna apparatus, the center conductor and the external conductor of coaxial cable 4 are respectively connected to capacitors 2 and 3. The capacitor 2 is formed by a pair of square electrodes disposed so that they are opposite to each other on both sides of glass plate 1. The capacitor 3 is formed by a pair of square electrodes disposed so that they are opposite to each other on both sides of glass plate 1. The capacitor 2 and the end portion of external antenna 300 are connected through capacitor C. In addition, the capacitor 3 and the end portion of external antenna 300 are connected through inductor L.

FIG. 1B shows an example of an antenna apparatus of AP143 type by AVANTI, USA. In this antenna apparatus, single capacitor 2 disposed so that respective electrode portions are opposite to each other through glass plate 1 is used. Antenna 300 is connected to one electrode of the capacitor 2, and the internal conductor of coaxial cable 4 is connected to the other electrode. The external conductor of coaxial cable 4 is connected to the internal conductor of coaxial cable 4 through an impedance circuit composed of inductor L and capacitor C.

As another example of such glass transmission type antenna, there is "glass transmission type antenna for car radio" described in the Tokkaihei No. 3-34704 publication (Japanese Patent Application Laid Open No. 34704/1991 publication. This antenna utilizes LC multiple (double) tuning circuit of electromagnetic coupling formed through glass plate with respect to FM signal, and utilizes capacitor and FET amplifier formed through glass plate with respect to AM signal, thus to carry out transmission of high frequency signal between the inside and the outside of compartment.

Moreover, in the glass transmission type antenna apparatus of this kind, since attachment position of the antenna is limited to the portion on the glass surface, there is a demand such that coaxial cable is extended as it is toward the outside of the compartment to install (provide) desired kinds of antennas at suitable portions of the roof of the vehicle body, or the like. Similarly, also in house, there is a demand such that optimum kinds of antennas are installed (provided) at suitable portions of veranda (porch) or the roof of the house, or the like except for the window glass.

In the "transmission apparatus" in the Jikkaihei No. 1-129924 (Japanese Utility Model Application Laid No. 129924/1989) publication, and the Tokkaihei No. 1-198836 (Japanese Patent Application Laid Open No. 198836/1989) publication, there is disclosed an example of a transmission apparatus in which center conductors of coaxial cables are connected to each other by capacitor coupling through glass.

However, in the conventional antenna apparatus or coupling (transmission) apparatus of this kind, while coaxial cable is wired up to the portion in the vicinity of the surface of glass plate, coaxial cables inside and outside the compartment are mechanically and structurally shield by the glass plate. For this reason, it is impossible to transmit high frequency energy with the coaxial transmission mode being maintained between external antenna apparatus outside the glass plate and coaxial cable within the compartment, or between inside and outside coaxial cables of a structure in which the glass plate is put therebetween.

As a result, impedance matching between the coaxial cable and the antenna is not satisfactorily obtained. Antenna current flows into e external conductor of the coaxial cable. Thus, so called leakage of radio wave from the coaxial cable is apt to occur. In addition, transmission efficiency of high frequency power is low. There were problems to be improved as described above.

In view of the above, with a view to permitting signal transmission in which the coaxial transmission mode is maintained, "coupling device for coaxial cable and antenna apparatus" was proposed by the Tokuganhei No. 5-325809 (Japanese Patent Application No. 325809/1993). FIG. 2 is a perspective view for explaining the fundamental configuration of the invention according to this application.

In the figure, glass plate 1 of dielectric substance serving as a portion of the wall surface which demarcate (partition) closed space (not shown) corresponds to window glass of vehicle or window glass of building, etc. One space side partitioned by glass plate 1 corresponds to, e.g., the interior of the vehicle or the interior of room, and the other space side corresponds to outside of vehicle or exterior of house.

Disk-shaped center conductor coupling electrode $2_1$ is disposed on one principal surface of the glass plate 1. There is disposed annular external conductor coupling electrode $3_1$ circumferentially surrounding the center conductor coupling electrode $2_1$. The center conductor coupling electrode $2_1$ is connected to center conductor $5_1$ of coaxial cable $4_1$ through inductor L. The external conductor coupling electrode $3_1$ is corrected to external conductor $6_1$ of coaxial cable $4_1$ through metallic shield member $7_1$ as occasion demands. The shield member $7_1$ covers the entirety of center conductor coupling electrode $2_1$, inductor L and external conductor coupling electrode $3_1$ to maintain signal transmission of the coaxial mode up to the glass surface, thus to prevent leakage of radio wave to the external or inductive interference from the external.

Also on the other principal surface of glass plate 1, center conductor coupling electrode $2_2$ is similarly disposed in a manner opposite to the center conductor coupling electrode $2_1$. Moreover, annular external conductor coupling electrode $3_2$ is disposed in a manner opposite to the external conductor coupling electrode $3_1$. The center conductor coupling electrode $2_2$ is connected to center conductor $5_2$ of coaxial cable $4_2$. The external conductor coupling electrode $3_2$ is connected to external conductor $6_2$ of coaxial cable $4_2$ through metallic shield member $7_2$. The shield member $7_2$ covers the entirety of center conductor coupling electrode $2_2$ and external conductor coupling electrode $3_2$ to maintain signal transmission of the coaxial mode up to the glass surface to prevent leakage of radio wave to the external or inductive interference from the external. To the other end of the coaxial cable $4_2$, e.g., antenna apparatus (not shown) is connected. To the other end of the coaxial cable $4_1$, transceiver (transmitter/receiver) (not shown) is connected.

By such a configuration, center conductor coupling electrodes $2_1$ and $2_2$ form capacitors on the disk opposite to each other through glass plate 1 to electrically connect between internal conductors $4_1$ and $4_2$ of the coaxial cables by capacitive coupling. External conductor coupling electrodes $3_1$ and $3_2$ also form annular capacitors opposite to each other through glass plate 1 to electrically connect between external conductors $6_1$ and $6_2$ of the coaxial cables by capacitive coupling. Inductor L is inserted in series with the capacitor to cancel capacitance produced by capacitive coupling to provide impedance matching. Accordingly, at the coupling portion between coaxial cables $4_1$ and $4_2$, external coupling electrodes are disposed so as to surround the outer circumferences of the center coupling electrodes, and respective center conductors and respective external conductors are coaxially coupled. At the coupling portion in which impedance matching is established, the coaxial transmission mode is maintained, and there is no radiation of radio wave from the center conductor coupling electrode, or no coupling to other portions. Thus, transmission is satisfactorily carried out in the unbalance state (higher frequency potential mode where potential of the center conductor shifts in positive or negative direction with potential of the external conductor being as reference potential).

However, in the conventional coaxial cable coupling devices and the conventional antenna apparatuses, consideration is made with respect to loss by capacitor coupling only from the point of view where center conductor systems (signal systems) of coaxial cables are caused to match with each other, thus to decrease transmission loss. Consideration is not particularly made in connection with the optimum coupling condition as a whole where matching with respect to the external conductor systems of the coaxial cables is taken into consideration as well.

SUMMARY OF THE INVENTION

Accordingly, an object of this invention is to provide a coupling device for coaxial cable and an antenna apparatus in various coupling forms in which the coupling condition capable of optimizing coupling between external conductors of coaxial cables is clarified so that coaxial cables mechanically shield by dielectric plate can be coupled under the condition where coaxial transmission mode is maintained at the inside and the outside the dielectric plate.

To achieve the above-mentioned object, a coupling device for coaxial cable of this invention is directed to a coupling device adapted for coupling coaxial cables to each other through a dielectric plate, the device comprising: a pair of center conductor coupling electrodes disposed in such a manner that they are opposite to each other through the dielectric plate, and respectively connected to center conductors of the coaxial cables; and a pair of external conductor coupling electrodes disposed so that they are opposite to each other through the dielectric plate, and respectively connected to external conductors of the coaxial cables, wherein the external conductor coupling electrode is formed so that electric length of the electrode in extending direction of the electrode from the junction between the external conductor and the external conductor coupling electrode is multiple of odd number of substantially one fourth (¼) wavelength of a passing signal transmitted through the coaxial cable.

Moreover, an antenna apparatus of this invention is directed to an antenna apparatus comprising: an antenna installed on one surface side of a dielectric plate; first and second capacitors provided with the dielectric plate being put therebetween, a coaxial cable existing on the other surface side of the dielectric plate, and such that a center conductor and an external conductors thereof are respectively connected to terminals of the other surface sides of the first and second capacitors; and a matching circuit connected between the antenna and respective terminals of the one surface sides of the first and second capacitors, wherein the second capacitor is formed so that electric length of the electrode in extending direction of the electrode from the junction between the external conductor and the electrode of the capacitor is multiple of odd number of substantially (¼) wavelength of a passing signal transmitted through the coaxial cable.

In the coaxial cable coupling device of the capacitor coupling type, in the case where center conductor coupling electrode connecting between center conductors of coaxial cables and external conductor coupling electrode connecting between external conductors are used, electric length of the external conductor coupling electrode is caused to be length of substantially (¼) wavelength of a passing signal, or is caused to be length of multiple of odd number of substantially (¼) wavelength thereof, thereby making it possible to carry out transmission by the coaxial transmission mode at extremely low loss. Further, width of the external conductor coupling electrode is increased, thereby making it possible to increase transmission bandwidth.

Moreover, matching circuit such that the coupling circuit portion has characteristic impedance of the transmission path at frequency of passing signal is inserted into the center conductor coupling electrode, thereby making it possible to provide the most satisfactory transmission characteristic as the entirety of the coaxial cable coupling device.

As described above, in accordance with the coaxial cable coupling device of this invention, external conductor coupling electrodes opposite to each other through the dielectric plate are caused to have length (electric length) of (¼) wavelength or multiple of odd number of (¼) wavelength of passing signal. Thus, even if coaxial cables are physically shielded by dielectric plate such as glass plate, etc., inside and outside coaxial cables are coupled to each other by the coaxial transmission mode and higher frequency power transmission of the unbalance mode is carried out between both coaxial cables. Accordingly, connection between coaxial cables of extremely low loss in set frequency band of signal can be made while ensuring the merit that there is no inductive interference from the external and no radio wave does not leak to the external.

Further, in accordance with the antenna apparatus of this invention, it becomes possible to carry out transmission and reception of power at extremely low loss while maintaining the coaxial transmission mode between the antenna portion and the coaxial cable through dielectric plate such as glass plate, etc. Furthermore, since the external conductor which is the ground system is drawn to the outside of vehicle (the exterior of house) and it can be connected to the ground system or the ground line, etc. of antenna, it is possible to easily connect such external conductor to the unbalance antenna. In addition, such external conductor can be connected also to the balance type antenna through balun (balance/unbalance transformer). Such antenna apparatus is preferably used in the telephone equipment mounted in vehicle of low output power.

DETAILED DESCRIPTION OF THE PREFERRED EMBODIMENTS

Various preferred embodiments of this invention will now be described in detail with reference to the attached drawings.

Figure 1A:
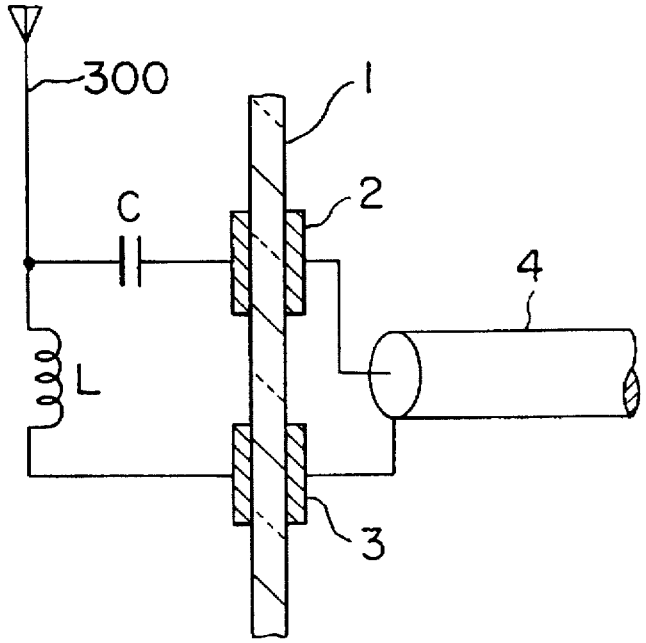
FIG. 1A PRIOR ART
FIG. 1A is an explanatory view showing an example of a conventional capacitor coupling type antenna.
Figure 1B:
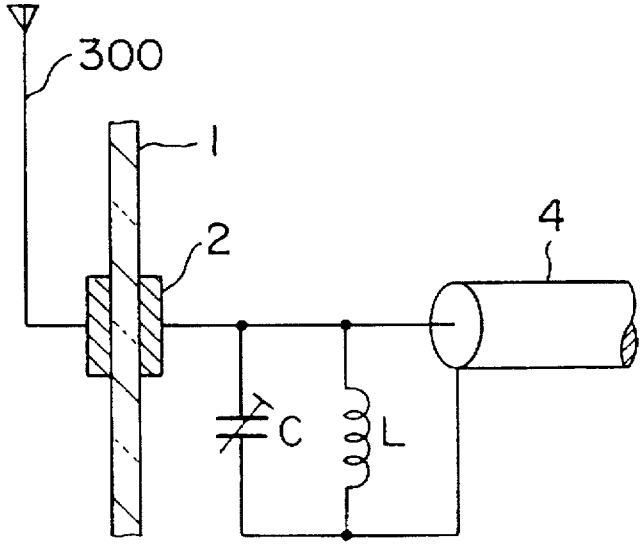
FIG. 1B PRIOR ART
FIG. 1B is an explanatory view showing another example of a conventional capacitor coupling type antenna.
Figure 2:
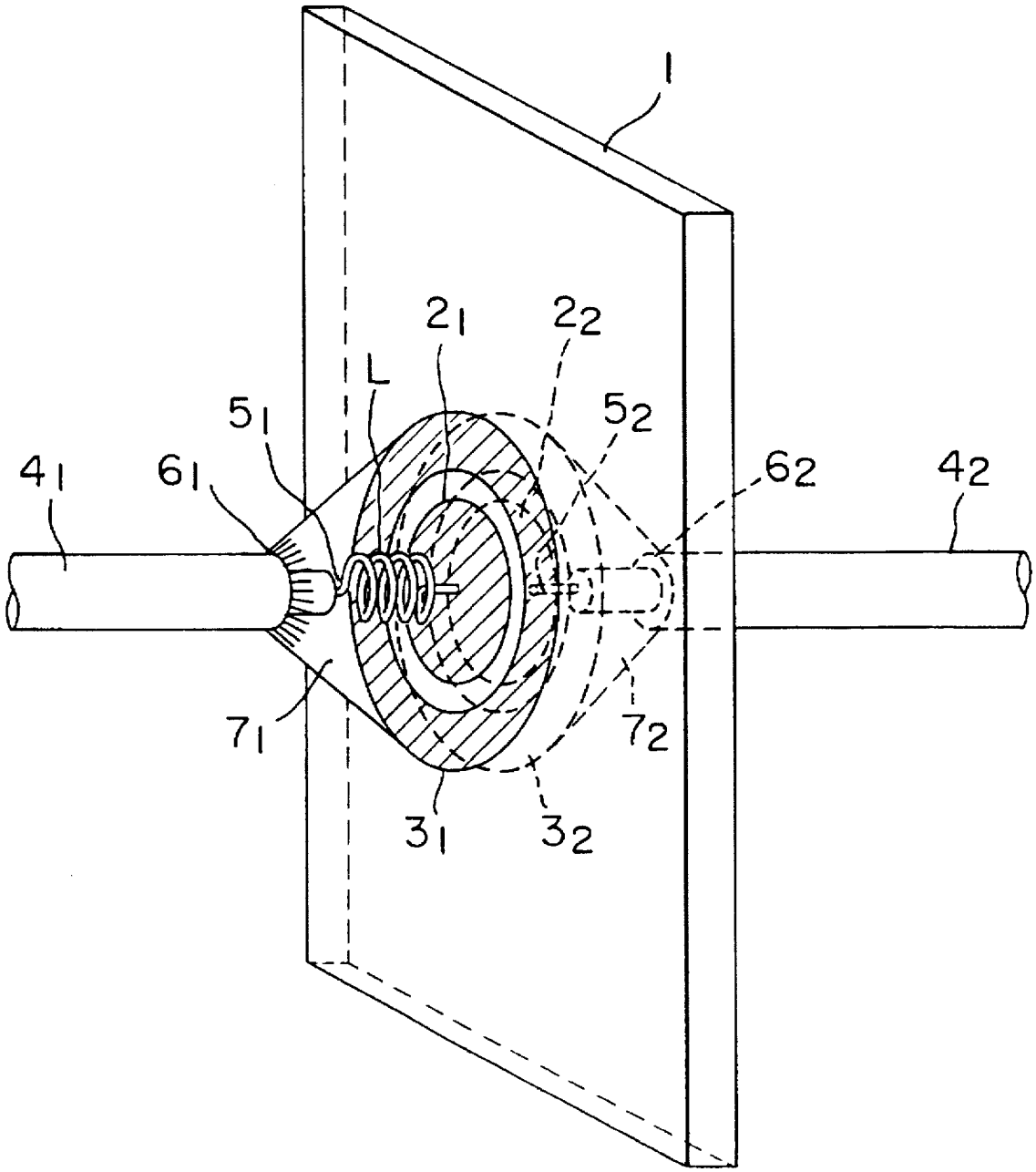
FIG. 2 PRIOR ART
FIG. 2 is an explanatory view showing an example of the configuration of a coaxial cable coupling device of the capacitor coupling type which permits the coaxial transmission mode.
Figure 3:
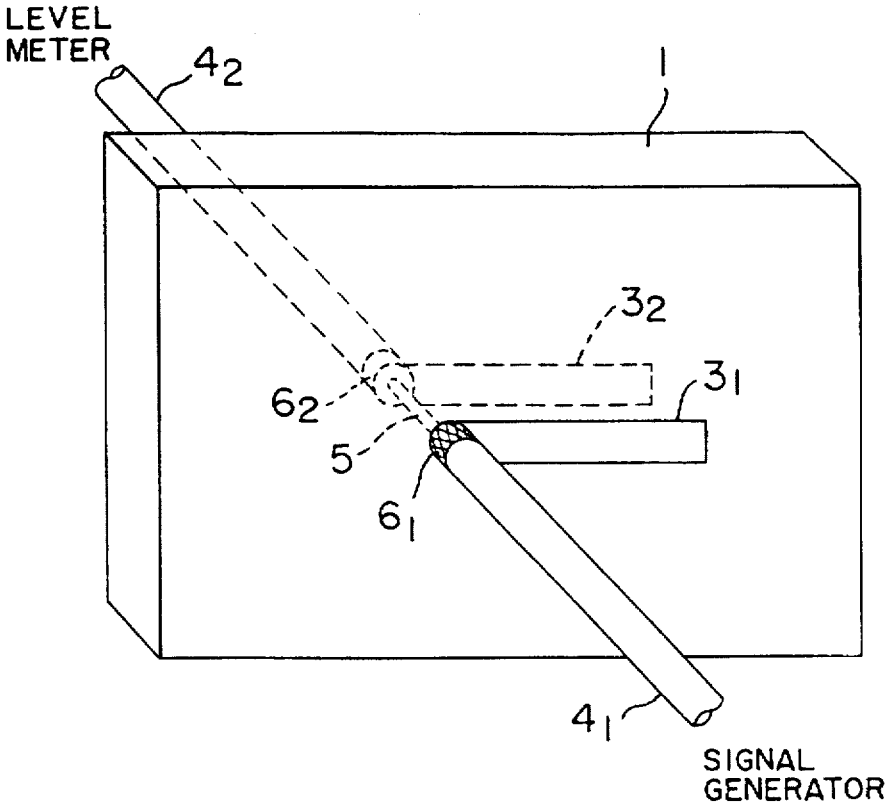
FIG. 3 is an explanatory view showing an example of the configuration for measuring transmission frequency characteristic of only external conductor coupling electrode.

Initially, the first embodiment will be described. With a view to examining the influence exerted on the device of external conductor coupling electrode of the coaxial cable coupling device, external conductor coupling electrodes of the coaxial cable coupling device were made up in various forms to respectively measure transmission characteristics. FIG. 3 shows an example of the configuration for this measurement, wherein a penetration hole of small radius for allowing only center conductor 5 of the coaxial cable to be passed therethrough is opened at glass plate 1. Coaxial cables $\mathbf{4}_1$ and $\mathbf{4}_2$ are disposed on the both sides of the glass plate 1 so that their centerconductors 5 are connected to each other through the penetration hole. An external conductor $\mathbf{6}_1$ of the coaxial cable $\mathbf{4}_1$ is connected to external conductor coupling electrode $\mathbf{3}_1$ stuck on the surface of the glass plate 1. An external conductor $\mathbf{6}_2$ of the coaxial cable $\mathbf{4}_2$ is connected to external conductor coupling electrode $\mathbf{3}_2$ stuck on the back of the glass plate 1. These external conductors $\mathbf{6}_1$ and $\mathbf{6}_2$ are disposed so that they are opposite to each other to form capacitor with glass plate 1 being as dielectric substance. When such a configuration is employed, a signal generator (not shown) is connected to coaxial cable $\mathbf{4}_1$ and a level meter is connected to coaxial cable $\mathbf{4}_2$, thereby making it possible to determine transmission frequency characteristic of only external conductor coupling electrodes $\mathbf{3}_1$ and $\mathbf{3}_2$.

Figure 4:
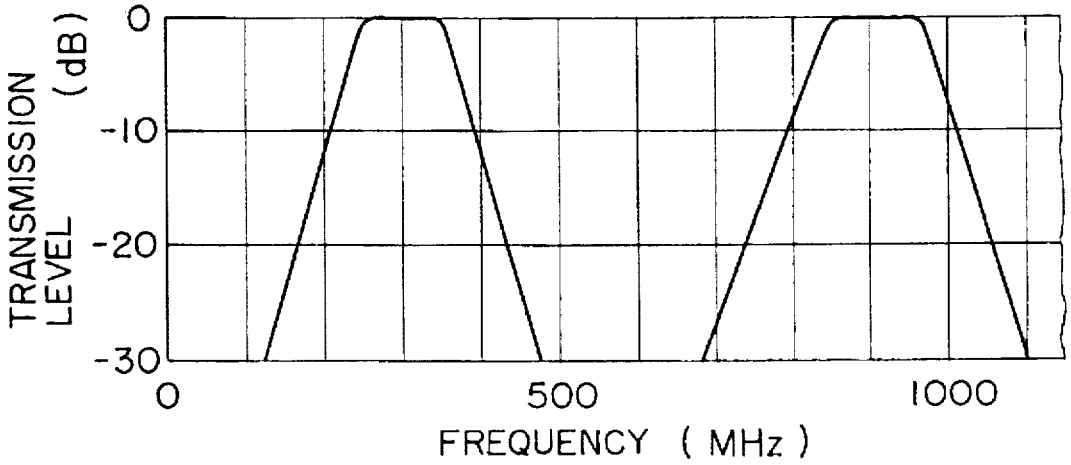
FIG. 4 is a graph showing an example of transmission characteristic of only external conductor coupling electrode.

FIG. 4 shows an example of measurement of transmission characteristic when the center conductors are directly connected to each other and external conductor coupling electrodes $\mathbf{3}_1$ and $\mathbf{3}_2$ are capacitor (capacitively) coupled. It has been confirmed that transmission of high frequency signal in this configuration is carried out under the state where the coaxial transmission mode is maintained. When the relationship between length of the external conductor coupling electrode and transmission frequency of a passing signal is determined in the above-mentioned transmission characteristic, it has become clear that extremely satisfactory transmission characteristic, e.g., −0.1 −0.3 dB is obtained at the frequency where length of the external conductor coupling electrode becomes equal to substantially ¼ wavelength of electric length of the electrode in which ambient dielectric constant is taken into consideration. Moreover, it has become clear that satisfactory transmission characteristic is obtained also at the frequency where length of the external conductor coupling electrode is equal to multiple of odd number of substantially ¼ wavelength. Further, shape of the external conductor coupling electrode was changed to conduct measurements with respect to electrodes of various forms.

As a result, the relationships as described below were obtained in connection with the external conductor coupling electrode.

(1) Frequency characteristic of the entirety of the coupling device is determined by length, width of the external conductor coupling electrode to which the external conductor is coupled. At the frequency where length (electric length) of the electrode corresponds to substantially 0.25 wavelength (¼ wavelength) of a passing signal, the maximum transmission efficiency is obtained. Also at the frequency where length of the external conductor coupling electrode corresponds to multiple of odd number of 0.25 wavelength such as 0.75 wavelength, etc. which is equivalently the same as 0.25 wavelength, peak of the transmission efficiency is similarly obtained.

Figure 5:
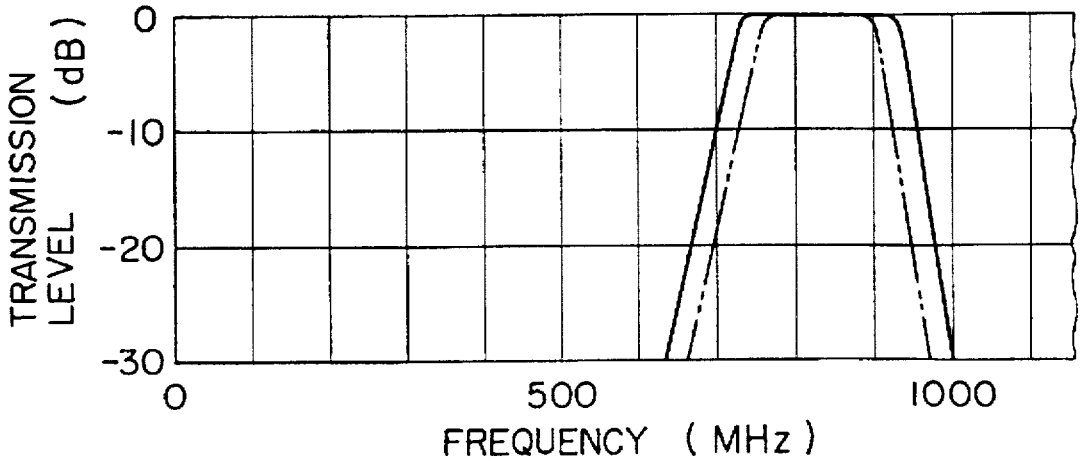
FIG. 5 is a graph showing comparison between bandwidth of transmission characteristics of the coaxial cable coupling devices by the electrode configurations shown in FIGS. 6 and 8.

(2) Width of the external conductor coupling electrode is related to the pass frequency bandwidth of the coupling device, and when width of the electrode is wide, broad pass frequency bandwidth is obtained as shown in FIG. 5.

(3) A plurality of external conductor coupling electrodes can be provided, and the relationships of (1) and (2) hold inconnection with respective external conductor coupling electrodes.

(4) When two external conductor coupling electrodes are constituted so that they are symmetrical in left and right directions, since respective opening ends become equal the same high frequency potential, both opening ends can be connected so as to take a loop form. At this time, there results the state equivalent to the fact that electrode width of one external conductor coupling electrode is doubled. This similarly applies to the case where even number of external conductor coupling electrodes are constituted so that they are symmetrical in left and right directions.

(5) When there is employed a configuration such that the center conductor coupling electrode is surrounded by the external conductor coupling conductor, leakage (of electromagnetic wave) from the center conductor coupling electrode is suppressed. When the center conductor coupling electrode is surrounded by 90% or more, leakage can be sufficiently suppressed (there is no significant difference).

(6) It is desirable that equivalent diameter of the center conductor coupling conductor is set to ⅛ wavelength or less. If equivalent diameter of the center conductor coupling electrode is too large, the center conductor coupling electrode begins to function as an antenna. As a result, radiation of radio wave is initiated, thus lowering the transmission efficiency.

When there is employed an approach to suitably adjust series inductance used in combination for matching of the center conductor coupling electrode to adjust its value to transmission frequency of the external conductor coupling electrode, overall transmission efficiency is improved.

It is possible to set characteristic impedance of the coupling device by capacitance values that the center conductor coupling electrode and the external conductor coupling electrode have.

It is preferable that impedance matching of the center conductor coupling electrode is carried out so as to provide desired characteristic impedance (e.g., 50 ohms) at a necessary frequency.

(7) When the external conductor coupling electrode is an electrode which can cope with a plurality of frequencies, a plurality of center conductor coupling electrodes can be provided. Filter is combined with a plurality of center conductor coupling electrodes, thereby making it possible to provide a plurality of series resonant characteristics.

(8) Since reduction rate is generated by dielectric constant of the dielectric plate, actual lengths of the coupling electrodes of the center conductor and the external conductor are equal to about 65 70% with respect to the electric length in the case where the dielectric plate is glass.

Preferred embodiments of the coaxial cable coupling device of this invention which have been carried out on the basis of the above-mentioned results will now be described with reference to the attached drawings.

Figure 6:
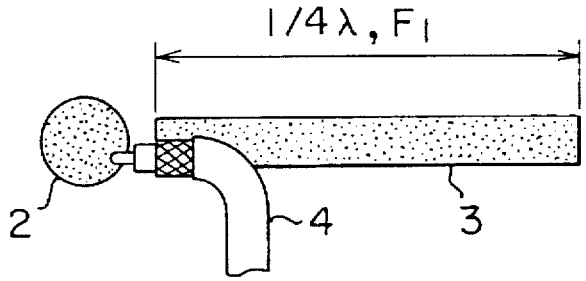
FIG. 6 is an explanatory view of an embodiment of this invention showing an example of shape of the center conductor coupling electrode and the external conductor coupling electrode of (¼) wavelength.

FIG. 6 shows the first embodiment of this invention, which is the most fundamental configuration. In this figure, there are shown one set of center conductor coupling electrode 2, external conductor coupling electrode 3 and coaxial cable 4 which are disposed on one surface of dielectric plate (not shown). Respective coupling electrodes are fixed, e.g., by sticking on the surface of the dielectric plate. While the other set of center conductor coupling electrode 2, external conductor coupling electrode 3 and coaxial cable 4 which are similarly constituted are disposed in a manner opposite to the above-mentioned set of coupling electrodes 2, 3 on the other surface of the dielectric plate, but the description thereof is omitted. This similarly applies to corresponding ones of configurations of FIGS. 7 to 26.

The feature of the configuration shown in FIG. 6 resides in that electric length of external conductor coupling electrode 3 is set to one forth (¼) of wavelength of a passing signal, e.g., carrier signal (frequency $F_1$) transmitted through the coaxial cable. The electric length of external conductor coupling electrode 3 is indicated, in terms of wavelength of the passing signal, by the distance from the junction between the external conductor of coaxial cable 4 and one end of the external conductor coupling electrode 3 up to the other end of the external conductor coupling electrode 3. Coupling is carried out, e.g., by soldering or connector. Since the electric length is shortened by the influence of ambient dielectric substance, actual physical length (actual length) of the external coupling electrode is represented by "actual length= electric length/($\epsilon^{1/2}$). In the above expression, is compound dielectric constant by air and glass. Since air dielectric constant $\epsilon_o$=1 and glass $\epsilon_g$=4, the compound dielectric constant is a value ranging therebetween. $1/\epsilon^{1/2}$ is reduction rate and is value of about 0.65 to 0.70.

For example, in the case where frequency $F_1$ of carrier signal is 300 MHz, (¼) wavelength of signal is (($3\times10^{10}$ cm)/($300\times10^{6}$))×(¼)=25 cm. If reduction rate is 0.65, required actual electrode length becomes equal to 16.25 (=25×0.65) cm.

Figure 7:
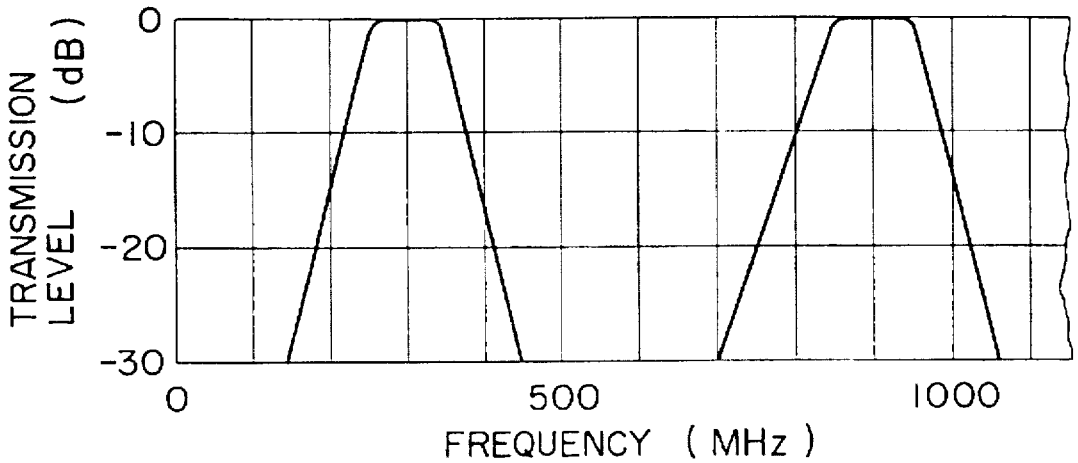
FIG. 7 is a graph showing transmission characteristic of the coaxial cable coupling apparatus by the electrode configuration shown in FIG. 6.

FIG. 7 shows transmission characteristic of the coaxial cable coupling device in which sets of center conductor coupling electrodes and external conductor coupling electrodes shown in FIG. 6 are caused to be opposite to each other through glass plate. In this figure, resonant frequency (pass band frequency) appears at 300 MHz and 900 MHz. They correspond to (¼)λ and (¾)λ of the passing signal, respectively. Also in the frequency range (not shown), it is confirmed that resonant frequencies exist. At frequencies corresponding to multiple of odd number of (¼)λ such as (¾)λ, (⁵⁄₄)λ, etc. which are electrically equivalent to (¼)λ, band pass characteristic having extremely small transmission loss can be obtained. At center frequency of the signal pass band, passing loss is −0.1 dB through −0.3 dB. Thus, it is seen that coupling between coaxial cables having substantially no loss is carried out. The reason why the signal pass bandwidth of the transmission characteristic shown in FIG. 7 is narrower than the transmission characteristic shown in FIG. 4 is that capacitor coupling by center conductor coupling electrode pair is supplemented to capacitor coupling by external conductor coupling electrode pair.

Figure 8:
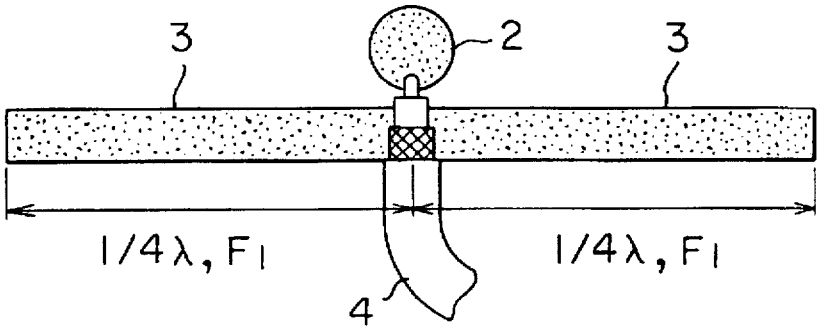
FIG. 8 is an explanatory view of an embodiment of this invention showing an example where there are provided two (¼) wavelength external conductor coupling electrodes of the same length.

FIG. 8 shows the example where two identical rod-shaped external conductor coupling electrodes 3 having length (electric length) of (¼)λ are symmetrically disposed. It has become clear that, with respect to the transmission characteristic in this case, the transmission bandwidth of the transmission characteristic shows a tendency to increase as compared to the case where only one external conductor coupling electrode 3 is provided as shown in FIG. 6. This is shown in FIG. 5. In this figure, the curve indicated by double dotted chain lines is the case where the number of external coupling electrodes is one as shown in FIG. 6. Moreover, the curve indicated by solid line is the case where two external conductor coupling electrodes 3 of the same length are connected as shown in FIG. 8. This corresponds to the fact that width of one external conductor coupling electrode 3 is increased from an electric point of view.

Figure 9:
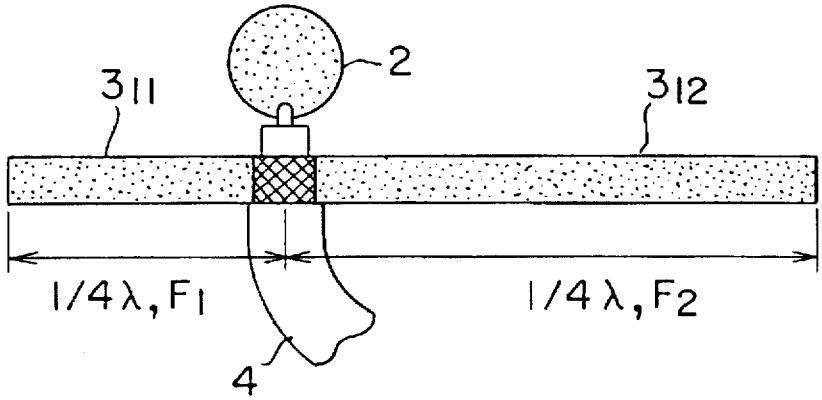
FIG. 9 is an explanatory view of an embodiment of this invention showing an example where there are provided two (¼) wavelength external conductor electrode of different lengths.
Figure 10:
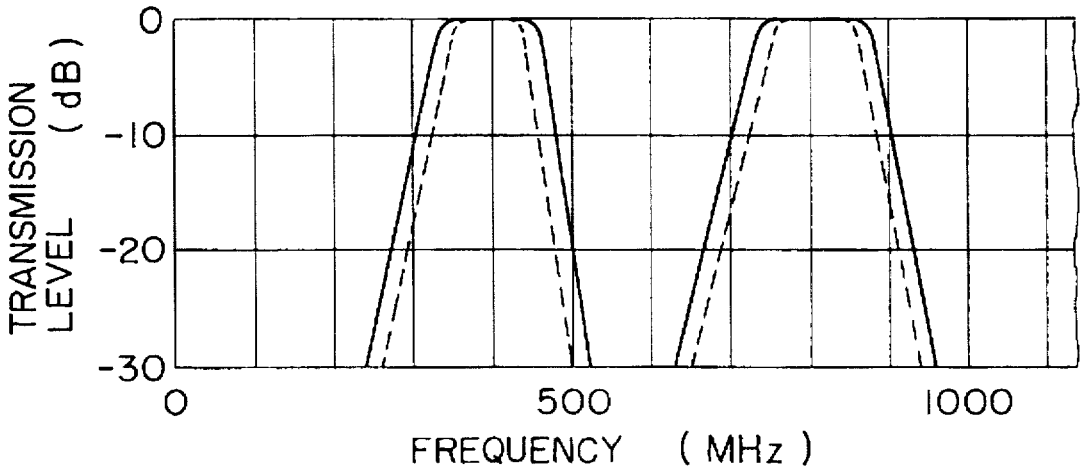
FIG. 10 is a graph showing comparison between transmission characteristics of the coaxial cable coupling devices by the electrode configurations shown in FIGS. 9 and 11.

FIG. 9 shows the example where two external conductor coupling electrodes of different lengths are used to obtain transmission characteristic having two pass bands. First external coupling electrode $3_{11}$ is constituted so that the electrode length becomes equal to (¼)λ with respect to a passing signal of frequency F1, e.g., 800 MHz. Second external coupling electrode $3_{12}$ is constituted so that the electrode length becomes equal to (¼)λ with respect to passing signal of frequency $F_2$, e.g., 400 MHz. The transmission characteristic based on this configuration is represented by curve of dotted lines in FIG. 10.

Figure 11:
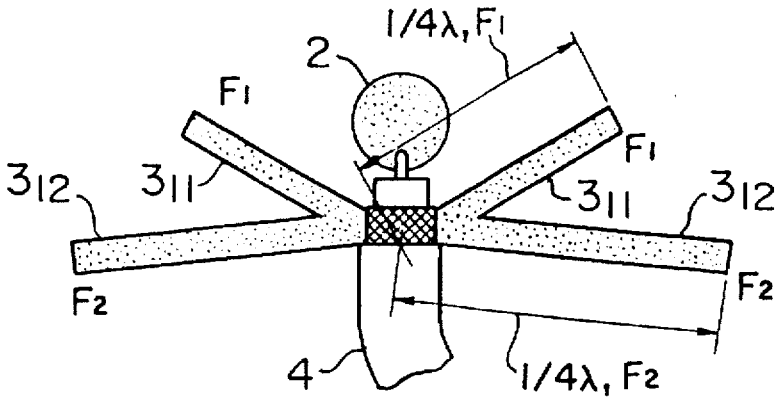
FIG. 11 is an explanatory view of an embodiment of this invention showing an example where there are provided two sets of (¼) wavelength external conductor coupling electrodes of different lengths.

FIG. 11 shows the example where two sets of external conductor coupling electrodes $3_{11}$ and $3_{12}$ shown in FIG. 9 are used and they are disposed so as to take V-shape to allow the transmission characteristic to be broad. The transmission characteristic based on this configuration is represented by the curve of solid line in FIG. 10. Employment of two identical external conductor coupling electrodes corresponds to widening of width of the electrode from an electric point of view. It is thus seen that respective pass bandwidth are caused to be broad.

Figure 12:
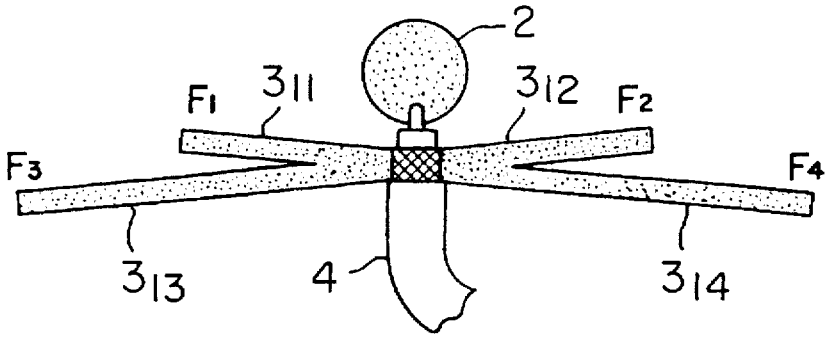
FIG. 12 is an explanatory view of an embodiment of this invention showing an example where there are provided plural (¼) wavelength external conductor coupling electrodes of different lengths.

FIG. 12 shows the example where a plurality of external conductor coupling electrodes $3_{11}$ through $3_{14}$ of different lengths are used to make a preparation such that respective lengths are equal to (¼) wavelength of passing signals (signal components) of four frequencies $F_1$ through $F_4$ to obtain four transmission bands. If respective frequencies are caused to be close to each other, transmission characteristics overlap with each other so that multiple (double) tuning characteristic is provided. Thus, the pass bandwidth is permitted to be broad.

Figure 13:
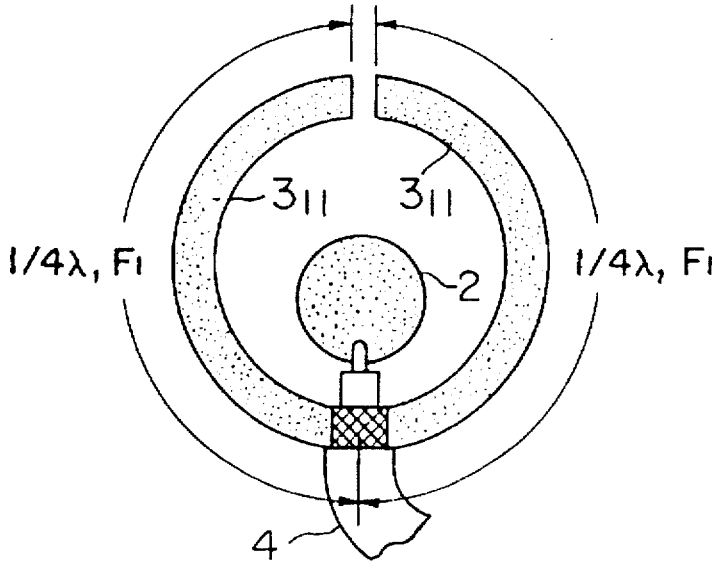
FIG. 13 is an explanatory view of an embodiment of this invention showing an example where the center conductor coupling electrode is surrounded by two (¼) wavelength external conductor coupling electrodes.

FIG. 13 shows the example where two external conductor coupling electrodes $3_{11}$, $3_{11}$ of the same length are symmetrically and annularly disposed so as to surround the center conductor coupling electrode. When the center conductor coupling electrode is surrounded by the external conductor coupling electrode, electromagnetic wave which leaks from the center conductor coupling electrode to the outside along the glass plate surface is reflected by the external conductor coupling electrode and is returned to the center conductor coupling electrode. Accordingly, loss of coupling is decreased.

Figure 14:
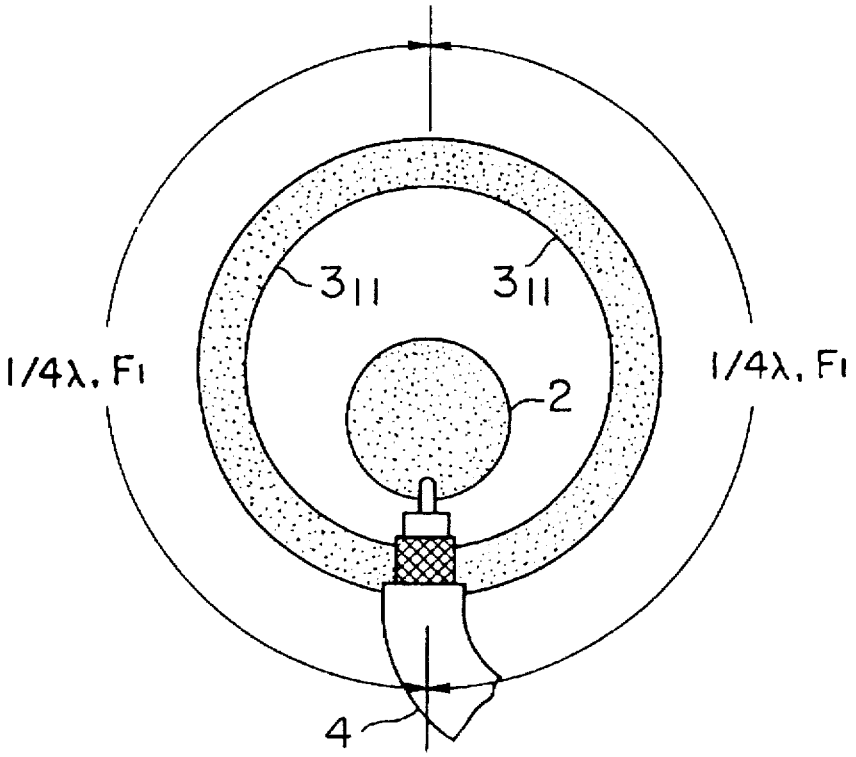
FIG. 14 is an explanatory view of an embodiment of this invention showing an example where the center conductor coupling electrode is annularly surrounded by two (¼) wavelength external conductor coupling electrode.

FIG. 14 shows the example where two external coupling electrodes $3_{11}$, $3_{11}$ of the same length shown in FIG. 13 are connected at the other ends. Since two external conductor coupling electrodes are symmetrically disposed with the coupling point being as reference, the other ends of (¼) wavelength external conductor coupling electrodes have the same potential from an electric point of view. Thus, the other ends of external conductor coupling electrodes can be connected to each other. When center conductor coupling electrode 2 is surrounded by external conductor coupling electrodes as shown in FIG. 13 or 14, electromagnetic wave leaking on the glass plate surface from center conductor coupling electrode 2 toward the outside is suppressed. Thus, transmission loss can be further decreased. When viewed from an experimental point of view, even if a portion of the annular external coupling electrode is opened by about 10% as shown in FIG. 13, there is not so great difference between suppressing ability of leakage in this case and that in the case where the external coupling electrode is completely closed.

Figure 15:
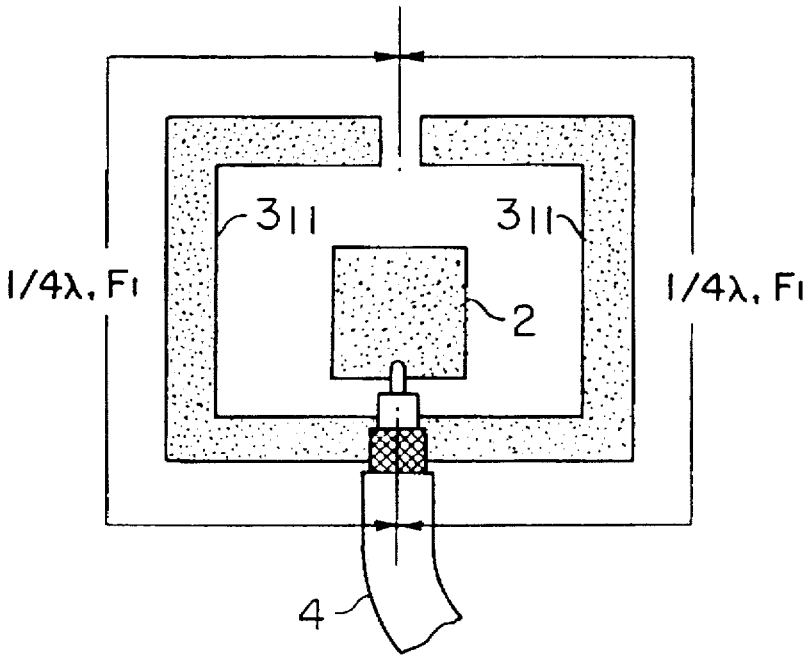
FIG. 15 is an explanatory view of an embodiment of this invention showing an example where the center conductor coupling electrode is surrounded by two square (¼) wavelength external conductor coupling electrodes.
Figure 16:
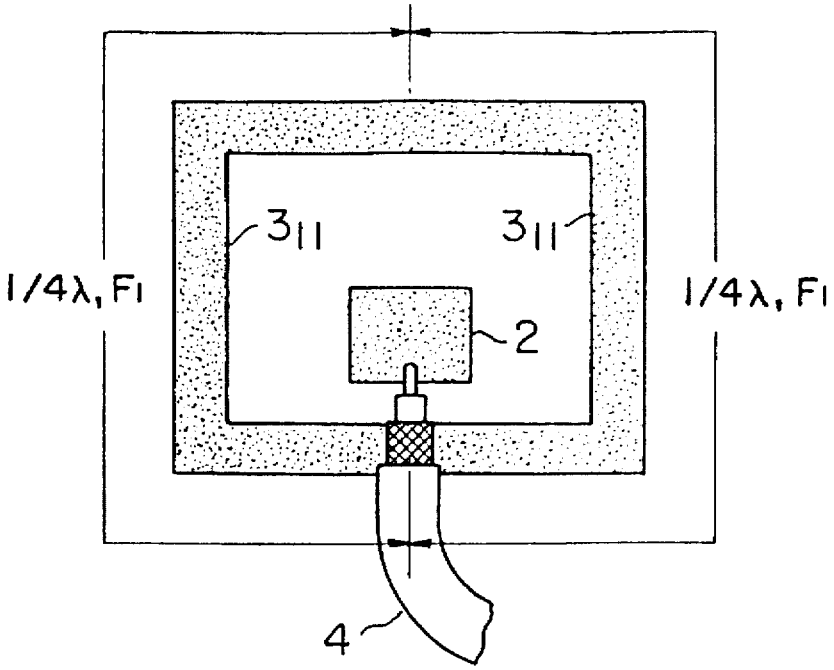
FIG. 16 is an explanatory view of an embodiment of this invention showing an example where the center conductor coupling electrode is annularly surrounded by two square (¼) wavelength external conductor coupling electrodes.

FIGS. 15 and 16 show the examples where annular external conductor coupling electrodes $3_{11}$ respectively shown in FIG. 13 and 14 are formed square. It is possible to form centerconductor coupling electrode 2 so as to take polygonal form (e.g., square form) in correspondence with shape of the external conductor coupling electrode. Also in this case, similar transmission characteristic is obtained.

Figure 17:
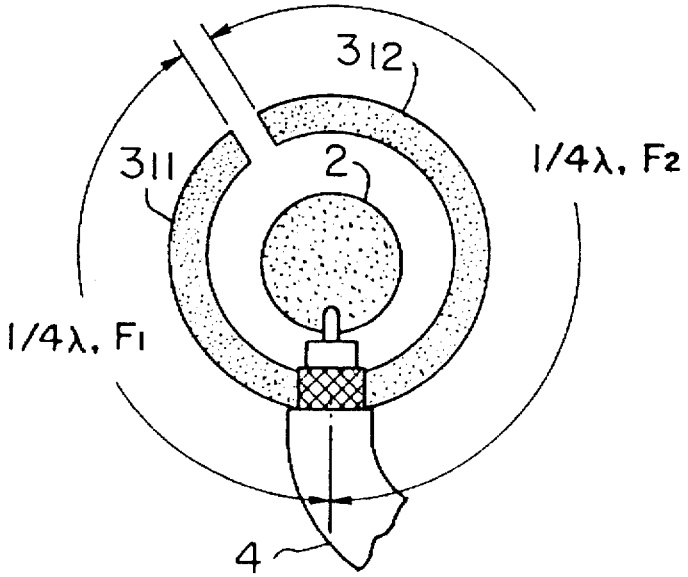
FIG. 17 is an explanatory view of an embodiment of this invention showing an example where the center conductor coupling electrode is surrounded by two (¼) wavelength external conductor coupling electrodes of different lengths.

FIG. 17 shows the example where two external conductor coupling electrodes $3_{11}$, $3_{12}$ shown in FIG. 13 are caused to be respectively tuned with respect to passing signals of different frequencies. External conductor coupling electrode $3_{11}$ is formed so that its electric length is equal to (¼) wavelength with respect to the passing signal of frequency $F_2$. External conductor coupling electrode $3_{12}$ is formed so that its electric length is equal to (¼) wavelength with respect to passing signal of frequency $F_2$. As the transmission characteristic of the coaxial cable coupling device, two signal passing characteristic as shown in FIG. 7 is obtained.

Figure 18:
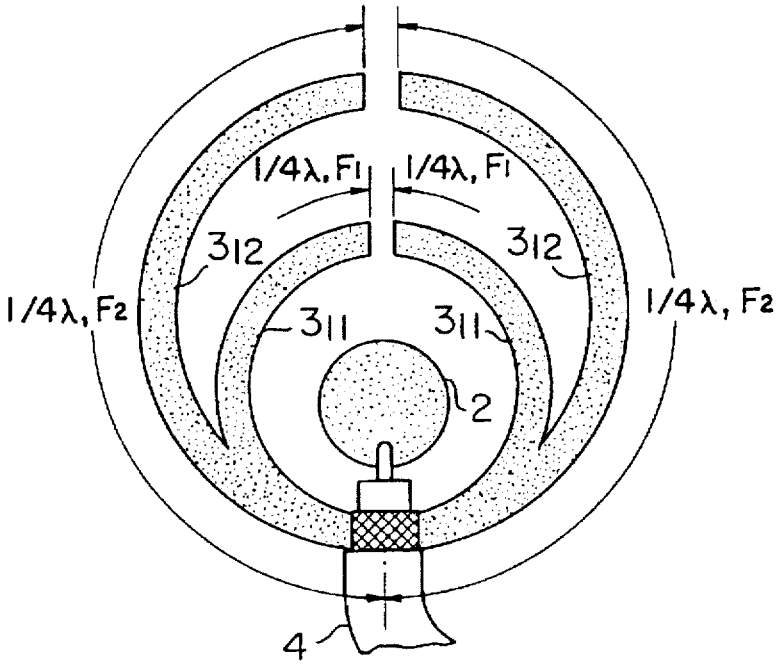
FIG. 18 is an explanatory view of an embodiment of this invention showing an example where the center conductor coupling electrode is doubly surrounded by two sets of (¼) wavelength external conductor coupling electrodes of different lengths.

FIG. 18 shows the example where two signal passing characteristic is obtained while allowing the frequency band of a signal transmitted to be broad. In FIG. 18, center conductor coupling electrode 2 is annularly surrounded by two external conductor coupling electrodes $3_{11}$, $3_{11}$ and the outsides of external conductor coupling electrodes $3_{11}$, $3_{11}$ are annularly surrounded by two external conductor coupling electrodes $3_{12}$, $3_{12}$.

The reason why, as shown in FIG. 18, center conductor coupling electrode 2, external conductor coupling electrode $3_{11}$ and external conductor coupling electrode $3_{12}$ are not concentrically disposed, but are disposed so that circumferences of external conductor coupling electrodes partially overlap with each other is to allow the center conductor coupling electrode and the external conductor coupling electrodes to be spaced therebetween so that both electrodes are not coupled by high frequency signal. Moreover, the other reason is to allow length of the external conductor coupling electrode from the coupling portion with respect to the external conductor to be easily in correspondence with (¼) wavelength.

Figure 19:
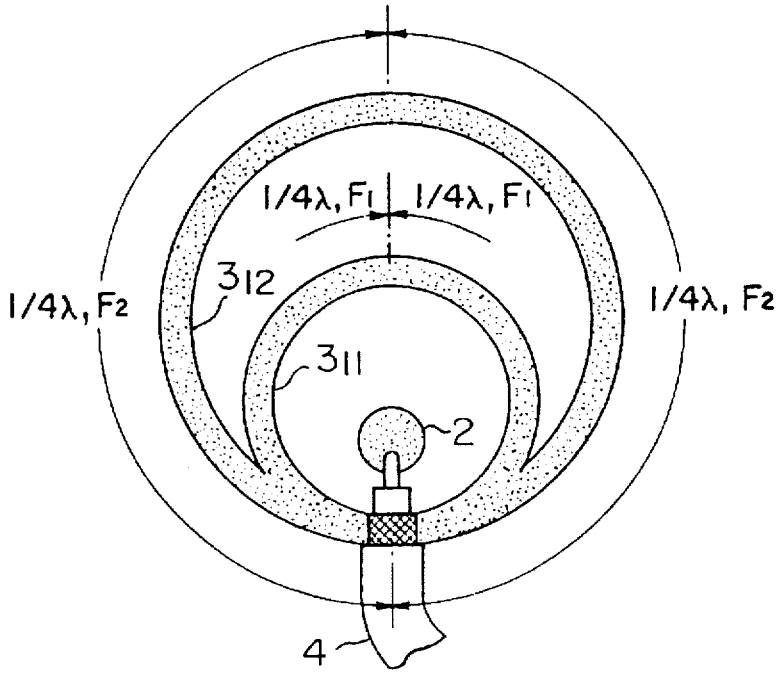
FIG. 19 is an explanatory view of an embodiment of this invention showing an example where two eccentric rings are formed by two sets of (¼) wavelength external conductor coupling electrodes of different lengths so as to doubly surround the center conductor coupling electrode.

FIG. 19 shows the example where the other end portions of two external conductor coupling electrodes $3_{11}$, $3_{11}$ and the other end portions of two external conductor coupling electrodes $3_{12}$, $3_{12}$ which are symmetrically disposed shown in FIG. 18 are respectively coupled. As previously described, since they are electrode portions which are symmetrical and have the same condition from an electric point of view, it is possible to connect them.

Figure 20:
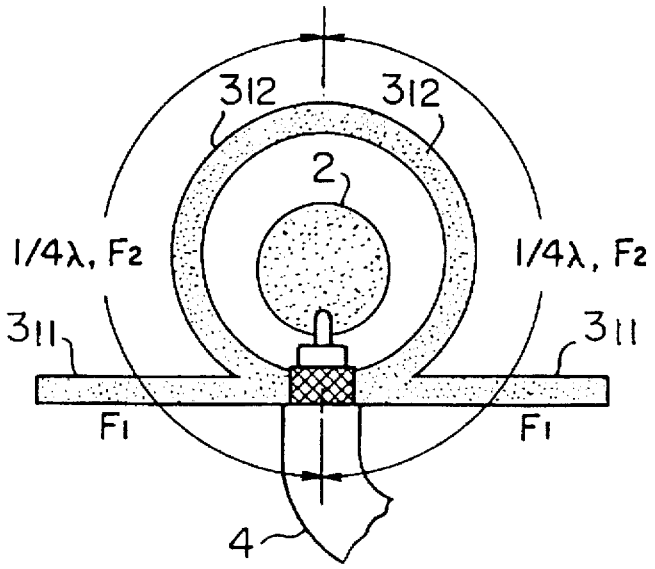
FIG. 20 is an explanatory view of an embodiment of this invention showing an example where the center conductor coupling electrode is annularly surrounded by a set of (¼) wavelength external conductor coupling electrodes of two sets of (¼) wavelength external conductor coupling electrodes of different lengths.

FIG. 20 shows the example where two external conductor coupling electrodes $3_{11}$, $3_{11}$ are radially disposed and two external conductor coupling electrodes $3_{12}$, $3_{12}$ are annularly disposed. Also in this case, two frequency pass band characteristic can be obtained.

Figure 21:
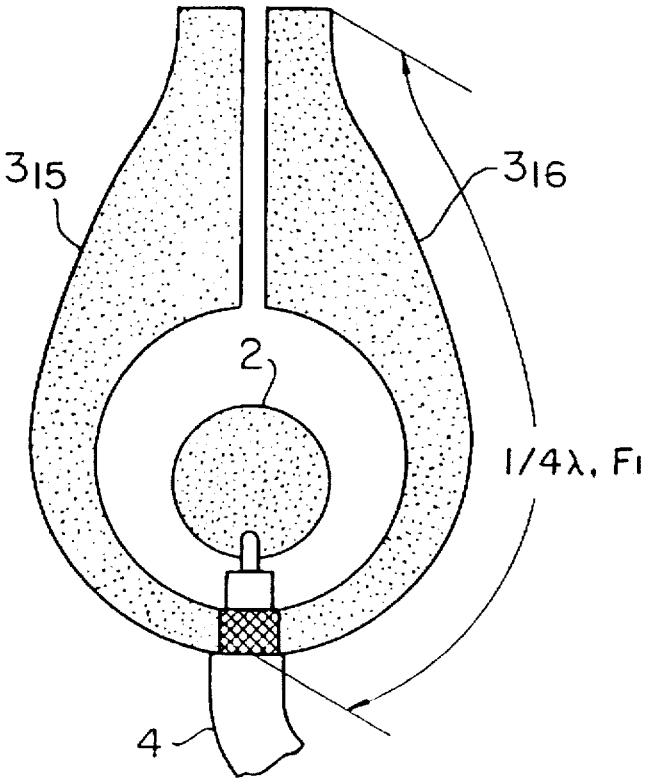
FIG. 21 is an explanatory view of an embodiment of this invention showing an example where the center conductor coupling electrode is surrounded by two wide (¼) wavelength external conductor coupling electrodes.

FIG. 21 shows the example where widths of two external conductor coupling electrodes $3_{15}$, $3_{16}$ are increased to thereby allow the signal pass bandwidth to be broad.

Figure 22:
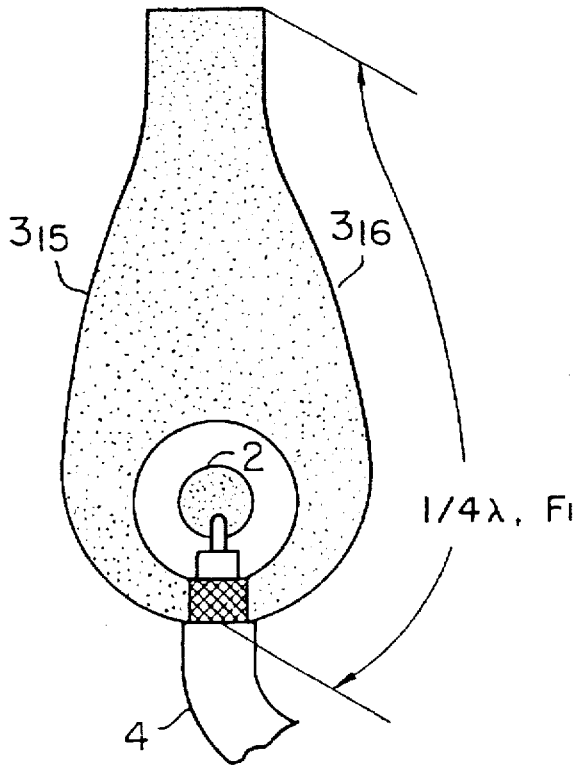
FIG. 22 is an explanatory view of an embodiment of this invention showing an example where two wide (¼) wavelength external conductor coupling electrodes are integrated so as to surround the center conductor coupling electrode.

FIG. 22 shows the example where two symmetric external conductor coupling electrodes $3_{15}$, $3_{16}$ shown in FIG. 21 are integrally coupled.

Figure 23:
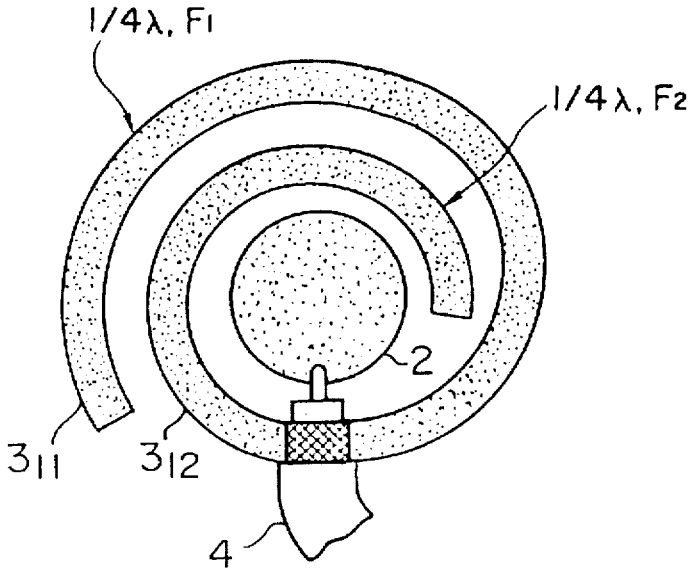
FIG. 23 is an explanatory view of an embodiment of this invention showing an example where the center conductor coupling electrode is surrounded by helical (spiral) (¼) wavelength external conductor coupling electrode.

FIG. 23 shows the example where two external conductor coupling electrodes $3_{11}$, $3_{12}$ of different lengths are helically (spirally) disposed with the center conductor coupling electrode being as center. When such a configuration is employed, it becomes possible to dispose relatively long electrodes in a manner so that occupation area is as small as possible.

Figure 24:
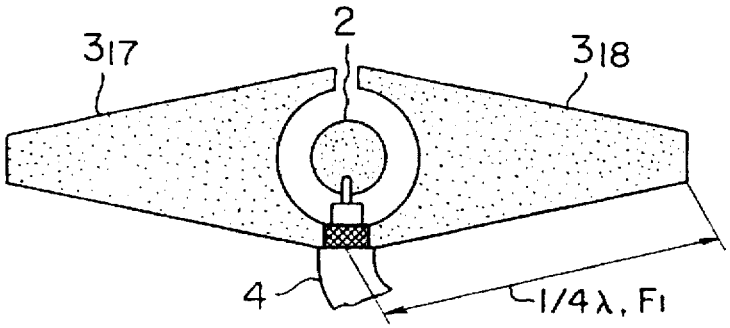
FIG. 24 is an explanatory view of an embodiment of this invention showing an example where two wide (¼) wavelength external conductor coupling electrodes are symmetrically disposed on the both sides of the center conductor coupling electrode.

FIG. 24 shows the example where two external conductor coupling electrodes $3_{17}$, $3_{18}$ of broad widths are used for allowing the transmission bandwidth to be broad. Such electrode may be prepared by etching of metallic thin film or punching of thinplate, etc.

Figure 25:
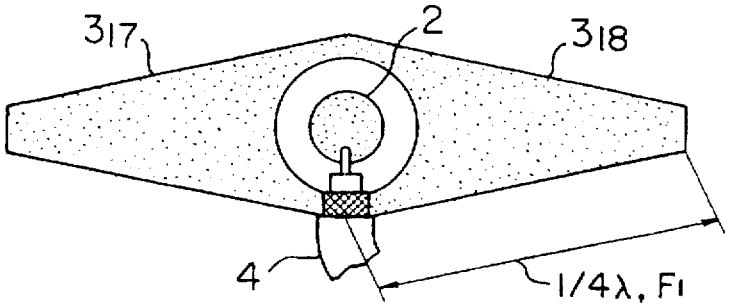
FIG. 25 is an explanatory view of an embodiment of this invention showing an example where the center conductor coupling electrode is surrounded by two wide (¼) wavelength external conductor coupling electrodes.

FIG. 25 shows the example where two external conductor coupling electrodes $3_{17}$, $3_{18}$ shown in FIG. 24 are integrally coupled.

Figure 26A:
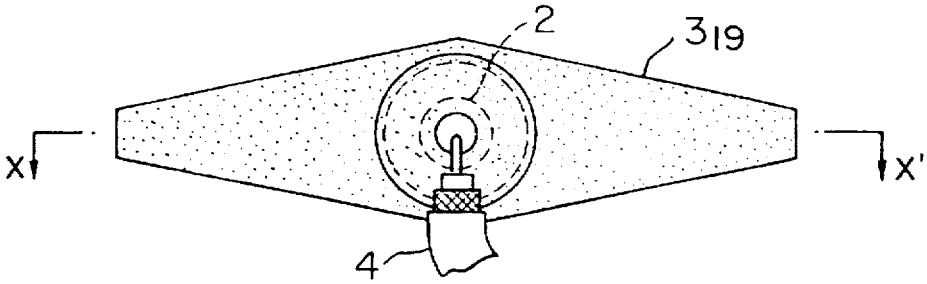
FIG. 26A is an explanatory view of an embodiment of this invention showing an example where the center conductor coupling electrode is covered by (¼) wavelength external conductor coupling electrode.

FIG. 26A is modification of the configuration shown in FIG. 25, wherein the coaxial cable coupling device is formed so that external conductor coupling electrode $3_{19}$ covers center conductor coupling electrode 2 disposed on glass plate 1. The external conductor coupling electrode $3_{19}$ is adapted so that, e.g., the portion opposite to center conductor coupling electrode 2 is formed by metallic film stacked on the surface (lower surface) of recessed plastic plate, or metallic plate coated on the surface (top) thereof, and the plastic plate is caused to function as cover of center conductor coupling electrode 2.

Figure 26B:
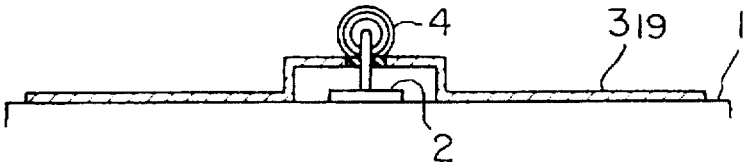
FIG. 26B is a cross sectional view in the X–X' direction of FIG. 26A.

FIG. 26B is cross sectional view in the X–X' direction of FIG. 26A. When external conductor coupling electrode $3_{19}$ is stuck on glass plate 1, center conductor coupling electrode 2 is confined (enclosed) within closed space in which insulation is taken into consideration, and is thus protected from droplet or moisture, etc.

Figure 27A:
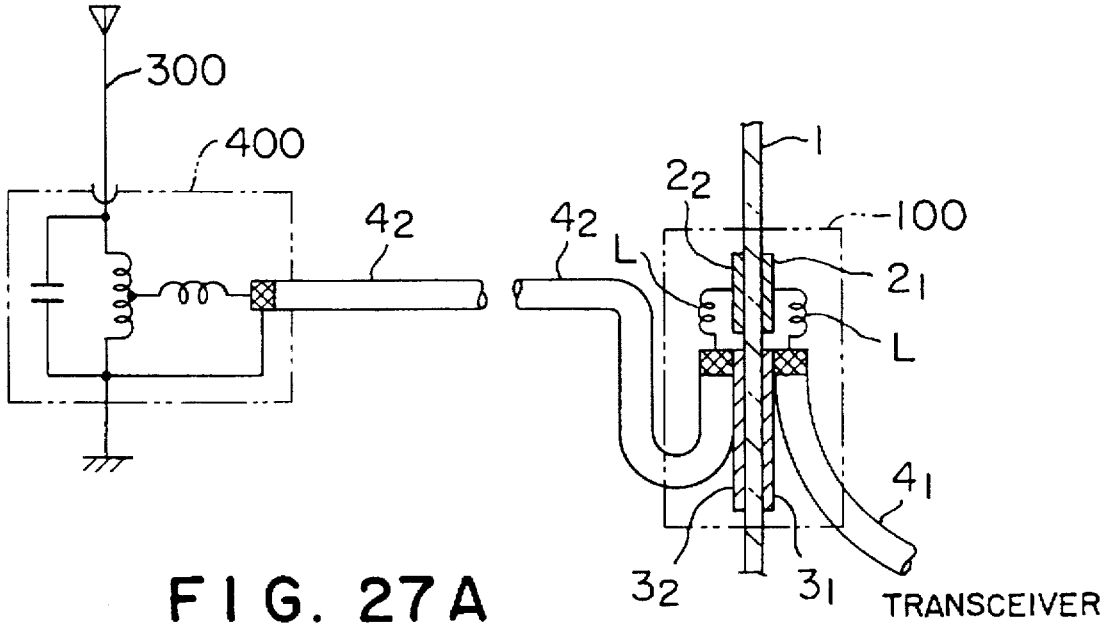
FIG. 27A is an explanatory view showing an example of use of the coaxial cable coupling device of this invention.

FIG. 27A shows the example where the coaxial cable coupling device of this invention is used to connect transceiver (transmitter/receiver) (not shown) within the interior of vehicle and an antenna apparatus positioned outside, wherein the right side of glass plate 1 corresponds to the inside of compartment of vehicle, and the left side corresponds to the outside of the vehicle. In FIG. 27A, coaxial cable $4_1$ connect between the transceiver and the coaxial cable coupling device 100. Coaxial cable $4_2$ connect between the coaxial cable coupling device 100 and antenna section matching circuit. As previously described, the coaxial cable coupling device 100 is composed of center conductor coupling electrodes $2_1$ and $2_2$ disposed oppositely to each other on the both sides of glass plate 1, external conductor coupling electrodes $3_1$ and $3_2$ of electric length of (¼) or (n/4) (n is odd number) wavelength disposed oppositely to each other on the both sides of glass plate 1, and matching circuit L for center conductor coupling electrode and center conductor of coaxial cable. The center conductor and the external conductor of coaxial cable $4_1$ are respectively connected to center conductor coupling electrode $2_1$ and external conductor coupling electrode $3_1$. The center conductor and the external conductor of coaxial cable $4_2$ are respectively connected to center conductor coupling electrode $2_2$ and external conductor coupling electrode $3_2$.

Antenna section matching circuit 400 is composed of transformer, inductor and capacitor, etc., and serves to realize impedance matching between coaxial cable $4_2$ and antenna 300. The ground system of antenna 300 is connected to the external conductor of the coaxial cable, and transmission of high frequency power of unbalance mode is carried out between antenna 300 and the transceiver.

Figure 27B:
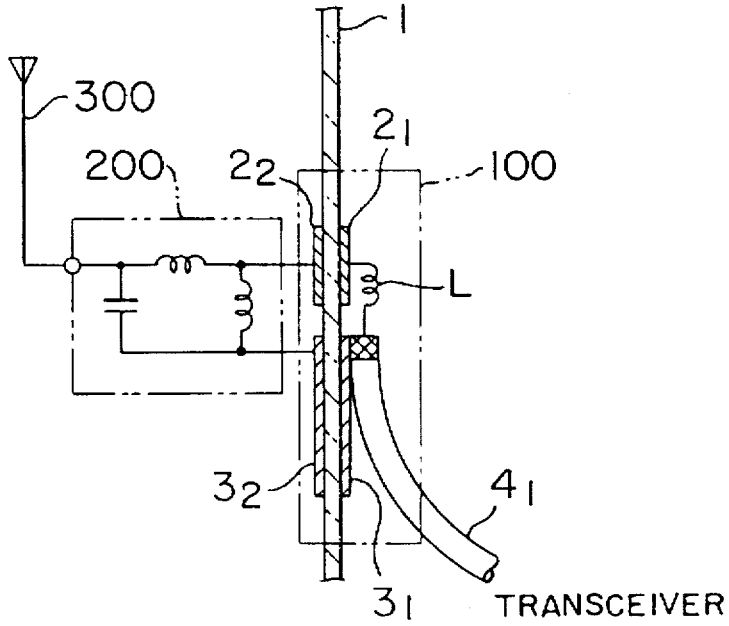
FIG. 27B is an explanatory view showing an example of use of an antenna apparatus of this invention.

FIG. 27B shows the example of antenna apparatus including coaxial cable coupling device 100, wherein coaxial cable coupling device 100 and antenna 300 are connected through matching circuit 200. Center conductor coupling electrode $2_2$ is connected to the line side of matching circuit 200, and external conductor coupling electrode $3_2$ is connected to the ground side of matching circuit 200. The antenna matching circuit 200 is composed of transformer, inductor and capacitor, etc. and serves to realize impedance matching between coaxial cable $4_1$ and antenna 300. By using external conductor coupling electrode $3_2$ of electric length of (¼)λ or (n/4)λ (n is odd number) wavelength, transmission of high frequency power by the coaxial transmission mode having extremely small transmission loss is carried out.

As external conductor coupling electrodes $3_1$ and $3_2$ in FIGS. 27A and 27B, electrodes of various forms shown in respective figures showing structures of the FIG. 6 to 26B mentioned above may be used.

It is to be noted that shape of the external conductor coupling electrode may be various shapes in addition to the shapes mentioned above. For example, there may be employed circular or fan-shaped external conductor coupling electrode having electric length of (¼)λ in radial direction, or trapezoid-shaped or triangular external conductor coupling electrode having electric length of (¼)λ in longitudinal direction.

Figure 28A:
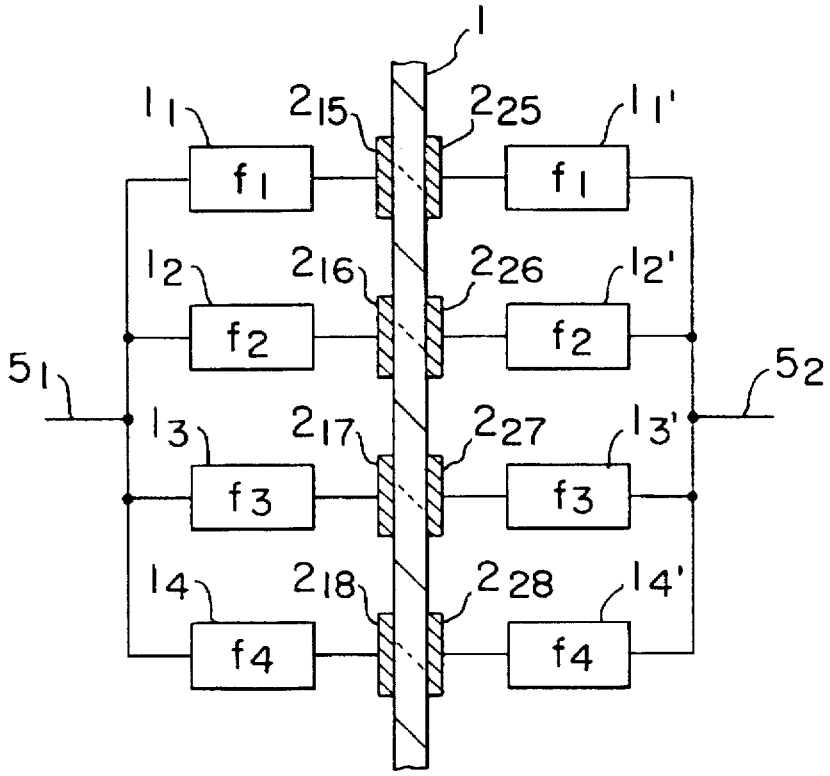
FIG. 28A is an explanatory view showing an example where plural center conductor coupling electrodes are provided and matching circuits are provided in respective center conductor coupling electrodes.
Figure 28B:
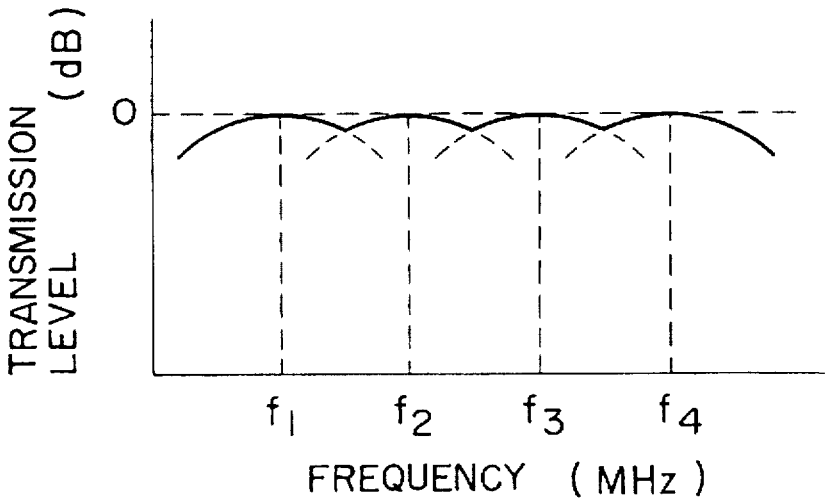
FIG. 28B is a graph showing an example of transmission characteristic in this case.

Moreover, when a plurality of or plural sets of external conductor coupling electrodes of (¼)λ are provided so that they correspond to plural frequencies, a plurality of center conductor coupling electrodes may be provided as shown in FIG. 28A. As an example of the configuration in which a plurality of center conductor coupling electrodes are provided, various examples of configurations are disclosed also in, e.g., the Tokuganhei No. 5-325809 (Japanese Patent Application No. 325809/1993). Filters of suitable characteristic (e.g., filters of pass frequencies $f_1$ to $f_4$) or matching circuits $1_1$ through $1_4$, $1'_1$ through $1'_4$ are combined with respective plural center conductor coupling electrodes, thus making it possible to obtain a plurality of series resonant characteristics as shown in FIG. 28B. These plural series resonant characteristics are caused to correspond to respective pass frequencies of the plural external conductor coupling electrodes. Moreover, in a plurality of signal pass frequencies, it is also possible to allow characteristic impedance of the coupling device to be in correspondence with the characteristic impedance of the coaxial cable.

In this way, the condition for connection between external conductor coupling electrodes is optimized, thus making it possible to ensure coaxial transmission mode of high frequency signal. Further, impedance of the center conductor coupling electrode portion is caused to match with characteristic impedance (e.g., 50 ohms) of the line at a required frequency by matching circuit, thus to optimize the condition required for connection between external conductor coupling electrodes. With respect to respective center conductor coupling electrodes and external conductor coupling electrodes, their connecting conditions are optimized thus to sufficiently reduce loss of signals transmitted therethrough. In addition, a filter (or matching circuit) of variable (adjustable) characteristic may be provided in the center conductor system to control the filter (matching circuit) so that various transmission characteristics are provided.

What is claimed is:

1. A coupling device for a plurality of coaxial cables, which is adapted for carrying out coupling between the coaxial cables through a dielectric plate, the device comprising:

a pair of center conductor coupling electrodes disposed so that said electrodes are opposite to each other by placing the dielectric plate between the center conductor coupling electrodes, and respectively connected to center conductors of the coaxial cables; and a pair of external conductor coupling electrodes disposed so that they are opposite to each other by placing the dielectric plate between the external conductor coupling electrodes, and respectively connected to external conductors of the coaxial cables, wherein the external conductor coupling electrodes are formed so that electric length of the electrodes in an extending direction of the electrodes from the junction between the external conductors and the external conductor coupling electrodes becomes equal to multiple of odd number of substantially one fourth wavelength of a passing signal transmitted through the coaxial cables.

2. The coupling device for a plurality of coaxial cables according to claim 1, wherein width of the electrodes in a direction perpendicular to an extending direction of the external conductor coupling electrodes are widened to allow the transmission characteristic of the coupling device to be broader.

3. The coupling device for a plurality of coaxial cables according to claim 2, wherein there are provided a plurality of external conductor coupling electrodes each connected to the external conductors, and a plurality of passing signals are caused to be transmitted through the coaxial cables, and wherein the plurality of external conductor coupling electrodes are formed so that electric length of any one of the external conductor coupling electrodes is caused to be multiple of odd number of substantially one fourth wavelength of any one of the plurality of passing signals.

4. The coupling device for a plurality of coaxial cables according to claim 1, wherein there are provided a plurality of external conductor coupling electrodes each connected to the external conductors, and a plurality of passing signals are caused to be transmitted through the coaxial cables, and wherein the plurality of external conductor coupling electrodes are formed so that electric length of any one of the external conductor coupling electrodes becomes equal to multiple of odd number of substantially one fourth wavelength of any one of the plurality of passing signals.

5. An antenna apparatus comprising:

an antenna installed on a first surface on one side of a dielectric plate;

a coaxial cable having a center conductor and an external conductor, wherein said external conductor is provided on a second surface on the other side of said dielectric plate;

first and second center conductor coupling electrodes having substantially the same shape and area, and being disposed on said first and second surfaces of said dielectric plate, respectively, wherein said first center conductor coupling electrode is connected to said antenna and said second center conductor coupling electrode is connected to said center conductor; and first and second external conductor coupling electrodes having substantially the same shape and area, and being disposed on said first and second surfaces of said dielectric plate, respectively, wherein said first external conductor coupling electrode is connected to said antenna and said second external conductor coupling electrode is connected to said external conductor, said first and second external conductor coupling electrodes are formed having an electric length equal to a multiple of odd number of substantially one fourth wavelength of a passing signal and said first and second external conductor coupling electrodes have a predetermined shape different from that of said first and second center conductor coupling electrodes, respectively, and have a predetermined position to said first and second center conductor coupling electrodes, respectively.

6. The antenna apparatus according to claim 5, wherein said first and second external conductor coupling electrodes surround said first and second center conductor coupling electrodes, respectively.

7. The antenna apparatus according to claim 6, wherein the shape of said first and second external conductor coupling electrodes are helical, where one end surrounds said first and second center conductor coupling electrodes and the other end further surrounds said one end.

8. The antenna apparatus according to claim 5, wherein the shape of said first and second center conductor coupling electrodes is a circle and the shape of said first and second external conductor coupling electrodes is a predetermined-shaped plate, said second external electrode is connected to said external conductor at the center position of the plate and is symmetrical to said center conductor coupling electrodes.

* * * * *